US008997425B2

(12) United States Patent
Bickmore

(10) Patent No.: US 8,997,425 B2
(45) Date of Patent: Apr. 7, 2015

(54) WALL PANEL SYSTEM AND METHOD

(71) Applicant: Helen Bickmore, Albany, NY (US)

(72) Inventor: Helen Bickmore, Albany, NY (US)

( * ) Notice: Subject to any disclaimer, the term of this patent is extended or adjusted under 35 U.S.C. 154(b) by 0 days.

(21) Appl. No.: 13/840,110

(22) Filed: Mar. 15, 2013

(65) Prior Publication Data

US 2013/0326988 A1 Dec. 12, 2013

Related U.S. Application Data

(60) Provisional application No. 61/657,084, filed on Jun. 8, 2012.

(51) Int. Cl.
*E04B 2/30* (2006.01)
*E04F 13/073* (2006.01)
*E04F 13/08* (2006.01)

(52) U.S. Cl.
CPC ..... *E04F 13/073* (2013.01); *E04F 13/0866* (2013.01)

(58) Field of Classification Search
CPC ..... A47B 81/002; E04B 2002/7485
USPC ..... 52/483.1, 489.1, 764; 211/135, 88.01
See application file for complete search history.

(56) References Cited

U.S. PATENT DOCUMENTS

| | | | | |
|---|---|---|---|---|
| 3,660,591 | A * | 5/1972 | Schultz et al. | 174/70 R |
| 4,804,094 | A * | 2/1989 | Eittreim | 211/88.01 |
| 4,984,763 | A * | 1/1991 | O'Donnell | 248/218.1 |
| 5,249,400 | A * | 10/1993 | Turner | 52/364 |
| 5,617,797 | A | 4/1997 | Casey | |
| 6,708,627 | B1 * | 3/2004 | Wood | 108/42 |
| 7,275,648 | B2 * | 10/2007 | Segovia, Jr. | 211/134 |
| 7,331,296 | B1 * | 2/2008 | Wood | 108/42 |
| 8,146,314 | B2 * | 4/2012 | Nguyen | 52/478 |

* cited by examiner

*Primary Examiner* — Jeanette E Chapman
*Assistant Examiner* — Daniel Kenny
(74) *Attorney, Agent, or Firm* — Heslin Rothenberg Farley & Mesiti, P.C.

(57) ABSTRACT

A wall panel system and method is disclosed. The wall panel system for covering an unfinished wall including one or more studs, includes a first sheet, a second sheet, and a first stud cover. The first sheet has a length, a width, a first edge, and a second edge. The second sheet is attached perpendicular to the first sheet at the second edge. The first stud cover is attached perpendicular to the first sheet at the first edge and the first stud cover includes a base with a first side and a second side, a first leg attached perpendicular to the base at the first side, and a second leg attached perpendicular to the base at the second side and wherein the first leg and second leg are parallel. Additional wall panel systems are also disclosed. In addition, storage units may be secured to the stud covers and the underlying studs.

14 Claims, 12 Drawing Sheets

WALL PANEL SYSTEM AND METHOD

CROSS-REFERENCE TO RELATED APPLICATIONS

This application claims priority benefit under 35 U.S.C. §119(e) of U.S. provisional application No. 61/657,084 filed Jun. 8, 2012, which is incorporated herein by reference in its entirety.

TECHNICAL FIELD

The present invention relates generally to building systems and, more particularly, to a wall panel system.

BACKGROUND

Many homes with unfinished garages, carriage houses, basements, and attics, particularly those built between the 1930's to 1960's, have exposed wood posts or studs, which are generally 2×4 inches or 2×6 inches. Currently, in the case of garages, many garages are small, with little room for storage beyond housing a small car. By drywalling directly over the studs and the area in between valuable storage space in between the studs is lost. Furthermore, drywalling a wall is more labor intensive and therefore can be costly. In addition, the studs and wood planks in between the studs may be difficult to paint and clean. The exposed wood also lacks any additional form of insulation for the interior space.

SUMMARY

In one aspect, provided herein is a wall panel system and method for lining studs and the spaces in between.

In another aspect of embodiments of the present invention, provided herein is a first wall panel for covering an unfinished wall including one or more studs. The first wall panel including a first sheet, a second sheet, and a first stud cover. The first sheet with a length, a width, a first edge, and a second edge. The second sheet attached perpendicular to the first sheet at the second edge. The first stud cover attached perpendicular to the first sheet at the first edge. The first stud cover includes a base with a first side and a second side, a first leg attached perpendicular to the base at the first side, and a second leg attached perpendicular to the base at the second side and wherein the first leg and second leg are parallel.

Another aspect of embodiments of the present invention, provided herein is a wall panel system for covering an unfinished wall including one or more studs. The wall panel system includes a stud cover with a base with a first side and a second side, a first leg attached perpendicular to the base at the first side, and a second leg attached perpendicular to the base at the second side and wherein the first leg and second leg are parallel.

Yet another aspect of the present invention, provided herein is a method for mounting a wall panel to an unfinished wall including one or more studs. The method includes the steps of obtaining a wall panel including at least one stud cover. The method further includes the steps of aligning the at least one stud cover over a first stud and sliding the at least one stud cover over the first stud. The method may also include the step of inserting at least one fastener through the at least one stud cover and into the first stud.

Additional advantages of lining the studs and the back of the area in between them with pre-fabricated wall lining consisting of pre-molded plastic, vinyl, or poly-carbon type material, that is durable and water resist, include providing additional insulation benefits and a brighter and modernized space. In addition, the space in between the studs may be utilized by an assortment of storage inserts and/or storage shelving designed to nestle in between the studs. The panels are designed to accept a variety of accessories including, but not limited to, shelving, baskets, hooks, and holders for storing various items, such as tools and toys. The wall panel system can also be used in basements, attics, or any other areas where the design of the home makes it difficult to get large pieces of drywall into the space to be finished. These pieces of wall paneling are light, easy to carry and put in place, as well as being moveable and removeable.

Another advantage of the present invention is the way it utilizes otherwise lost square footage for storage, as well as providing a washable, bright modern finish to the walls. Exposed studs are generally found in garages, sheds, basements, attics, and other areas with non-finished walls and when the wall system is used, storage capabilities may be maximized. The wall systems are useable in small areas that are generally difficult to finish using drywall techniques. Furthermore, the wall systems may provide water resistant capabilities and additional insulation.

These, and other objects, features and advantages of this invention will become apparent from the following detailed description of the various aspects of the invention taken in conjunction with the accompanying drawings.

BRIEF DESCRIPTION OF DRAWINGS

The accompanying drawings, which are incorporated in and constitute a part of the specification, illustrate embodiments of the invention and together with the detailed description herein, serve to explain the principles of the invention. The drawings are only for purposes of illustrating preferred embodiments and are not to be construed as limiting the invention.

DETAILED DESCRIPTION

Figure 1:
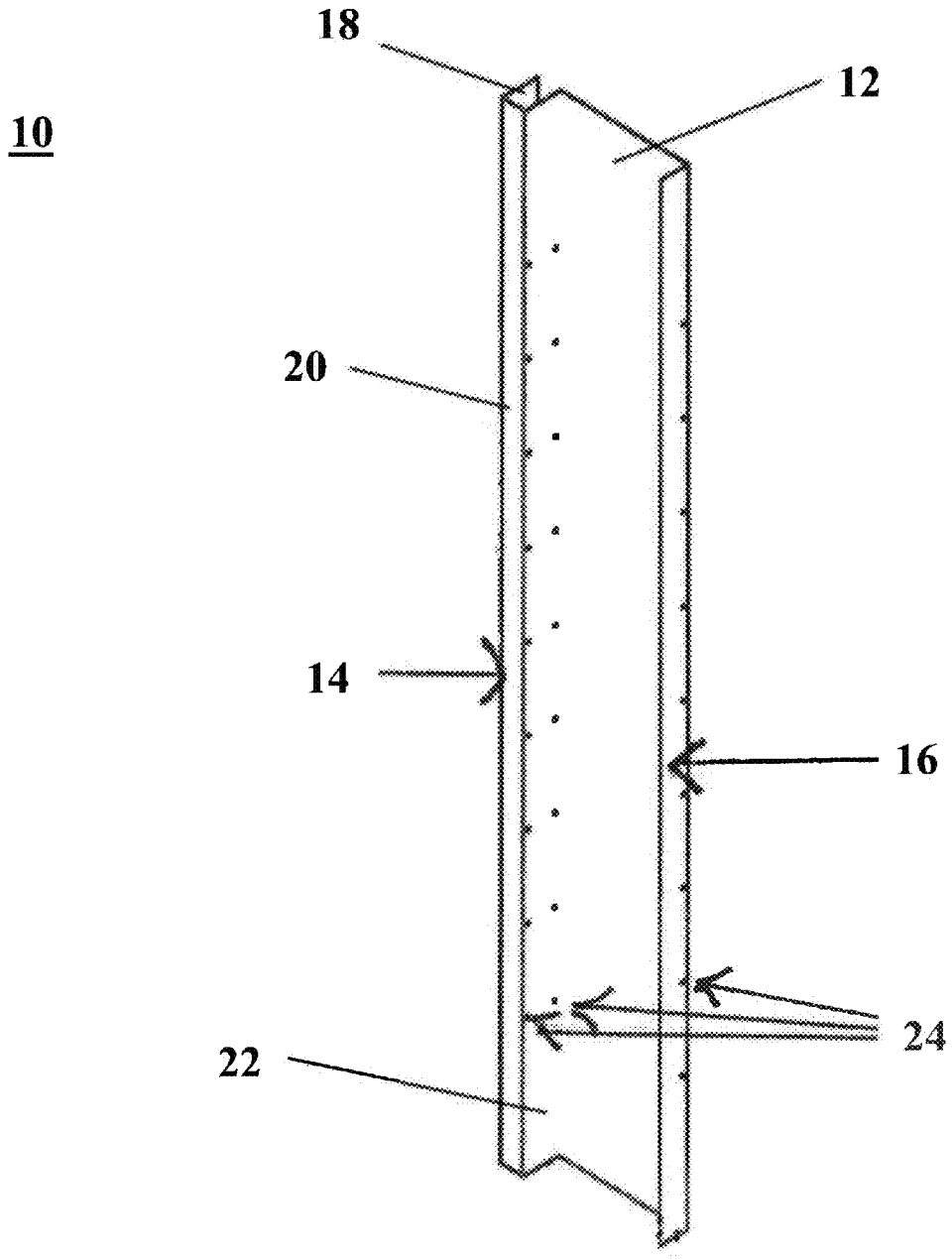
FIG. 1 is an isometric view of an embodiment single wall panel, in accordance with an aspect of the present invention.
Figure 2:
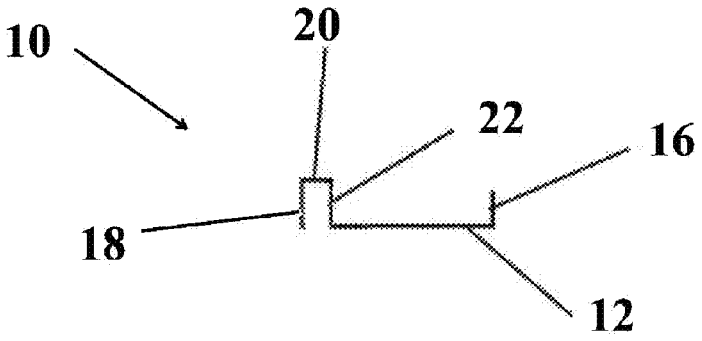
FIG. 2 is a bottom profile view of the single wall panel of FIG. 1, in accordance with an aspect of the present invention.
Figure 3:
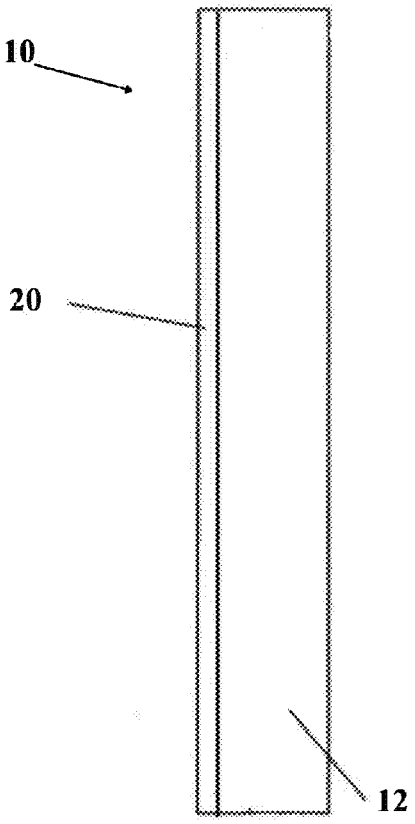
FIG. 3 is a front view of the single wall panel of FIG. 1, in accordance with an aspect of the present invention.
Figure 4:
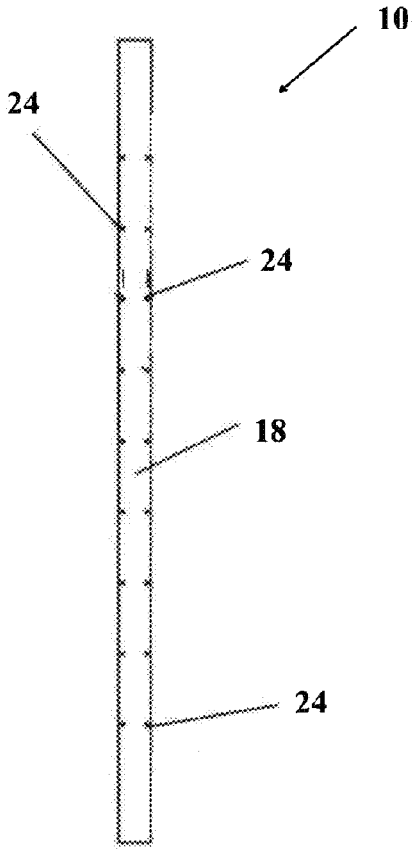
FIG. 4 is a side view of the single wall panel of FIG. 1, in accordance with an aspect of the present invention.

Referring to the drawings, wherein like reference numerals are used to indicate like or analogous components throughout the several views, and with particular reference to FIGS. 1-4, there is illustrated a wall panel 10. The panel 10 including a back sheet 12, a wrapped sheet 14 attached perpendicular to the back sheet 12 on a first end, and a side sheet 16 attached perpendicular to the back sheet 12 on a second end. The wrapped sheet 14 and the side sheet 16 being parallel to each other. The wrapped sheet 14 comprises a first sheet 18, a second sheet 20, and a third sheet 22 wherein the first sheet 18 is perpendicularly attached to the second sheet 20 on a first side and the third sheet 22 is perpendicularly attached to the second sheet 20 on a second side wherein the first sheet 18 is parallel to the third sheet 22. The wrapped sheet 14 may cover a stud, not shown, on three of the stud's four sides. The wrapped sheet 14 is configured to cover the stud on the interior side of an exterior wall.

The side sheet 16, and the first sheet 18 and second sheet 22 of wrap 14 may include a plurality of openings 24. The plurality of openings 24 may be used to secure the panel 10 to the studs of a wall. The panel 10 may be secured to the studs of a wall using one or more fasteners, such as screws, nails, or the like. It is preferable that the panel 10 is secured to the studs with a fastener that is removable so the panels could be removed if desired. In addition, the plurality of openings 24 may also be used to secure storage inserts, for example, shelves, containers, hooks, holders, and the like between two studs, to store various items, as discussed in greater detail below.

Figure 6:
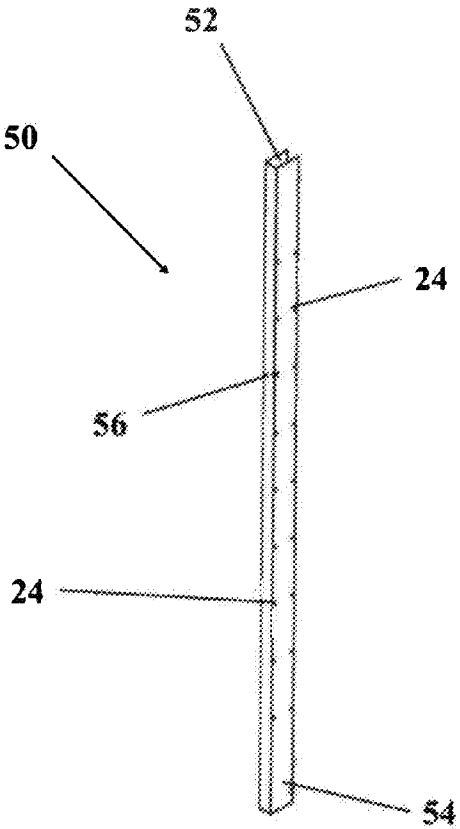
FIG. 6 is an isometric view of a wall panel end, in accordance with an aspect of the present invention.
Figure 5:
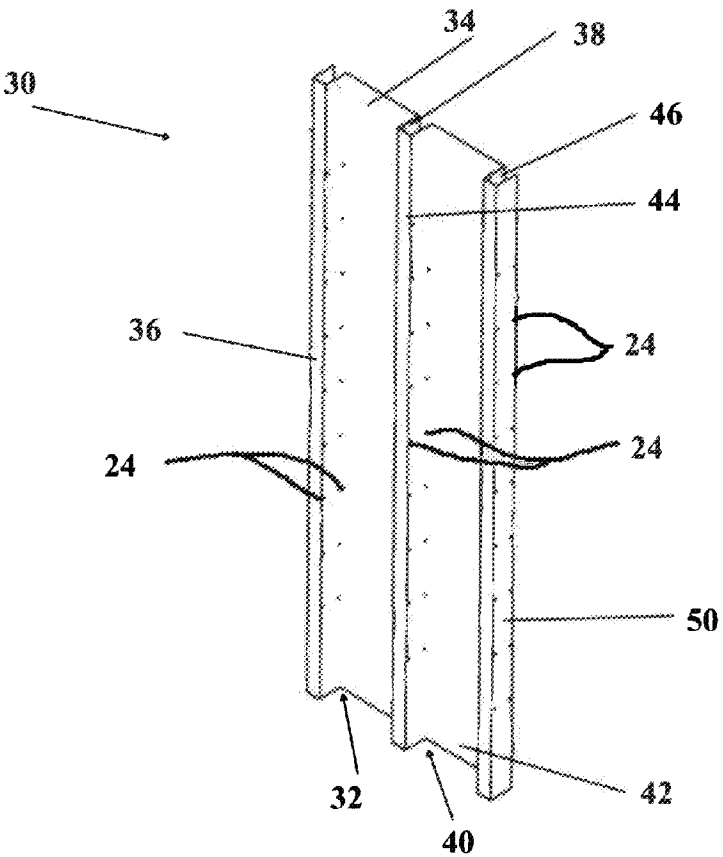
FIG. 5 is an isometric view of another embodiment wall panel with two panels, in accordance with an aspect of the present invention.
Figure 7:
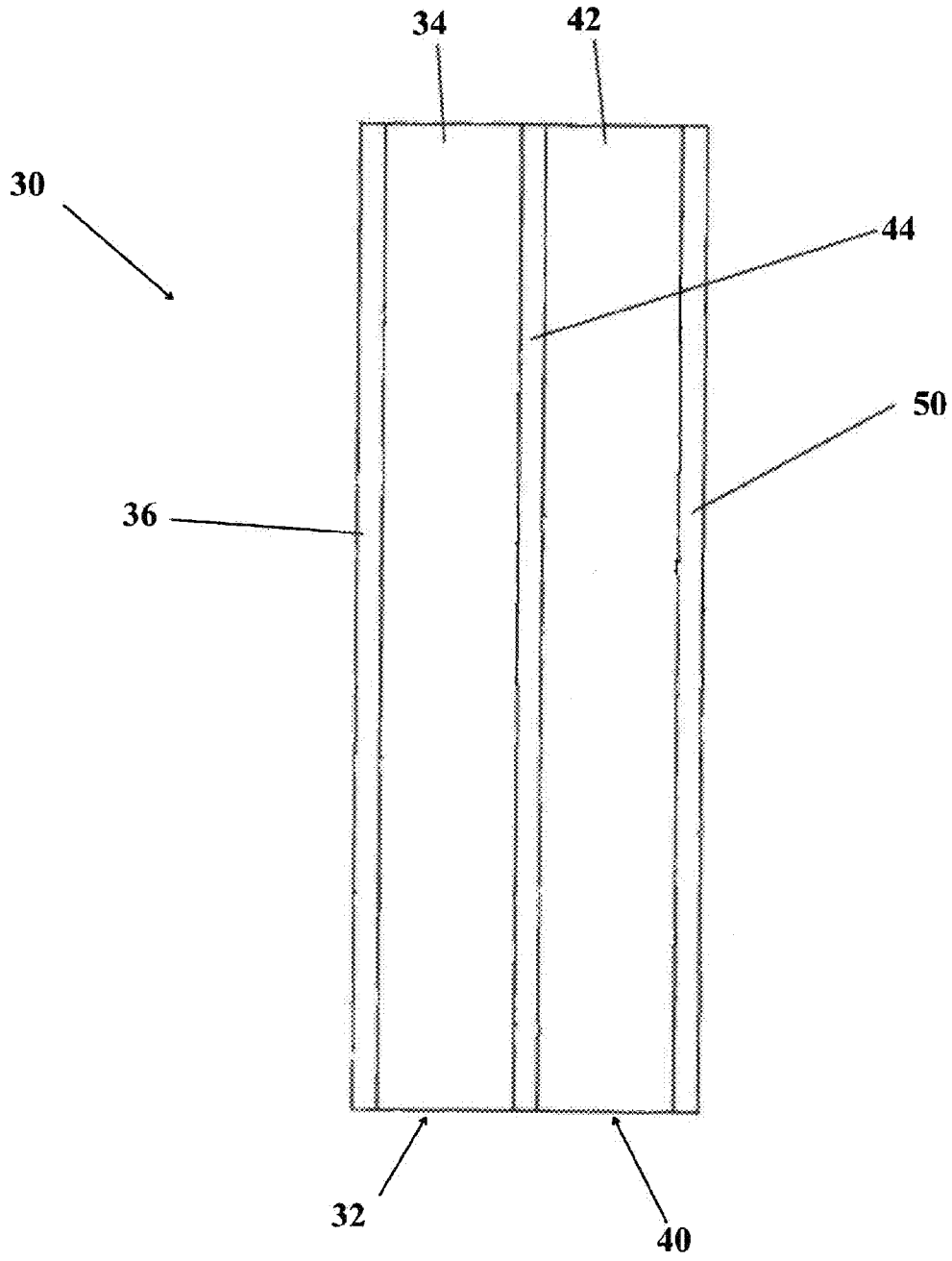
FIG. 7 is a front view of the wall panel of FIG. 5, in accordance with an aspect of the present invention.
Figure 8:
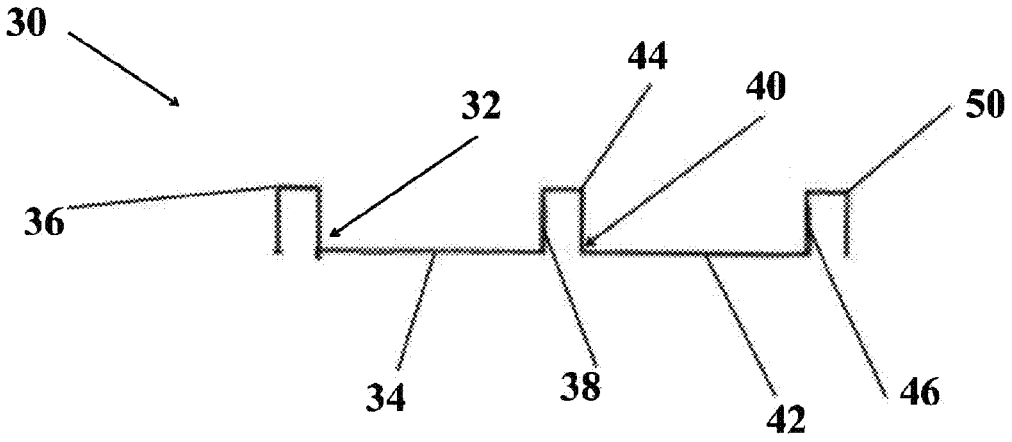
FIG. 8 is a bottom view of the wall panel of FIG. 5, in accordance with an aspect of the present invention.
Figure 9:
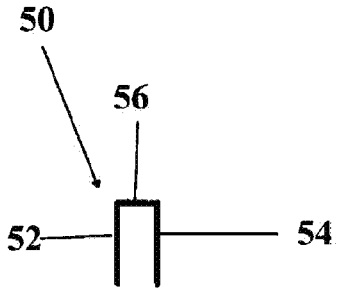
FIG. 9 is a bottom view of the wall panel end of FIG. 6, in accordance with an aspect of the present invention.
Figure 10:
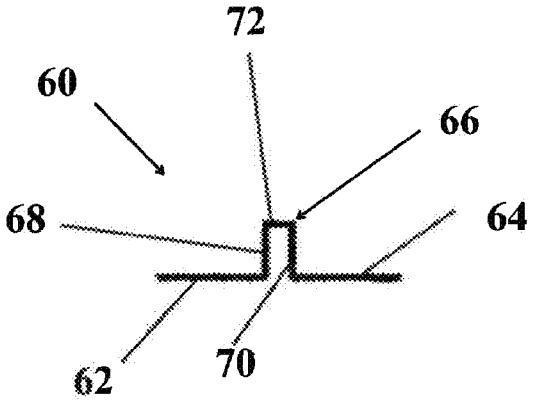
FIG. 10 is a bottom view of yet another embodiment wall panel with a centered stud covering, in accordance with an aspect of the present invention.
Figure 13:
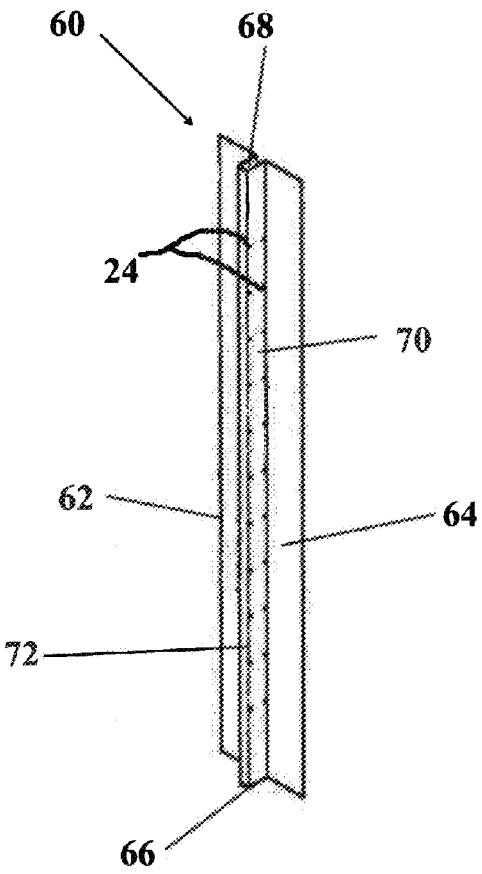
FIG. 13 is an isometric view of the wall panel of FIG. 10, in accordance with an aspect of the present invention.
Figure 12:
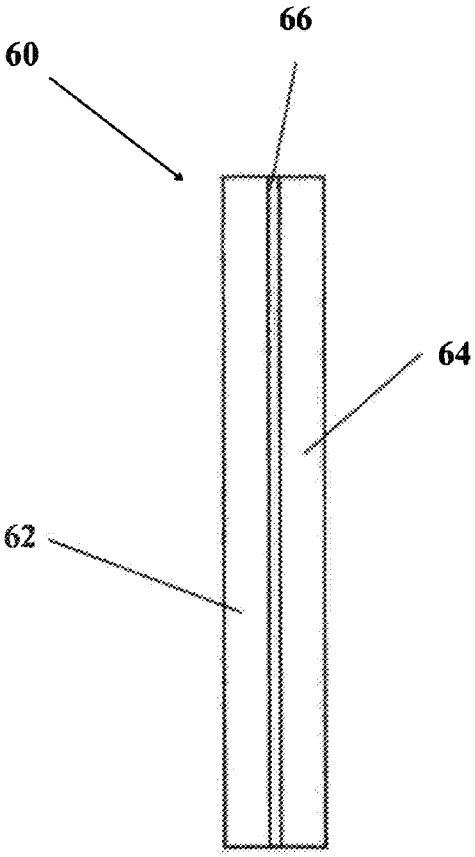
FIG. 12 is a front view of the wall panel of FIG. 10, in accordance with an aspect of the present invention.
Figure 11:
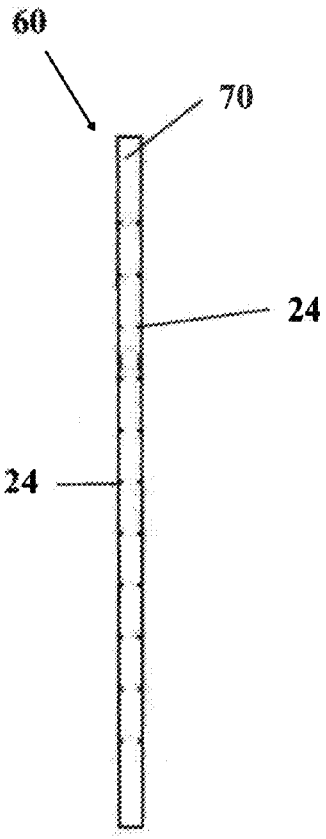
FIG. 11 is a side view of the wall panel of FIG. 10, in accordance with an aspect of the present invention.

Referring now to FIGS. 5-9, another embodiment wall panel system 30 is depicted in FIGS. 5, 7, and 8. The panel system 30 includes a first panel 32, a second panel 40, and a wall end panel 50. The first panel 32 and the second panel 40 are of the type described above with reference to panel 10 in FIGS. 1-4. The first panel 32 includes a back sheet 34, a wrapped sheet 36, and a side sheet 38. The second panel 40 includes a back sheet 42, a wrapped sheet 44, and a side sheet 46. The wrapped sheet 36 of the first panel 32 may be positioned over a first stud (not shown) and secured by inserting at least one fastener into one or more of the plurality of openings 24. When the wrapped sheet 36 is secured to the first stud the side sheet 38 will lay flush against a second stud that is adjacent to the first stud and the back sheet 34 will be flush with the wall. Then the second panel 40 may be positioned so wrapped sheet 44 slides over the second stud and the side sheet 38 thereby making the back sheet 42 flush with the wall (not shown). At least one fastener may be inserted into the plurality of openings 24 to secure the second panel 40 to the second stud. When the wrapped sheet 44 is secured to the second stud the side sheet 46 will lay flush against a third stud that is adjacent to the second stud. Where a user wishes for the wall panels to end they may insert a wall end panel 50, as depicted in FIGS. 6 and 9. The end panel 50 includes a first side 52 parallel a second side 54 and a front sheet 56 connecting the first side 52 and the second side 54. The end panel 50 may be positioned so it slides over the third stud and the side sheet 46 so that the first side 52 corresponds to the side sheet 46. At least one fastener may be inserted into the plurality of openings 24 to secure the end panel 50 to the third stud.

Referring now to FIGS. 10-13, yet another embodiment wall panel 60 is shown. The panel 60 includes a first sheet 62, a second sheet 64, and a wrapped sheet 66. The wrapped sheet 66 having a first side 68 parallel a second side 70 and a front side 72 connecting the first side 68 and second side 70. The wrapped sheet 66 may be positioned over a center stud and secured by inserting at least one fastener into one or more of the plurality of openings 24. When the wrapped sheet 66 is secured to the center stud the first sheet 62 may cover all or a portion of the wall between the center stud and the preceding stud and the second sheet 64 may cover all or a portion of the wall between the center stud and the following stud. The first sheet 62 and the second sheet 64 may be, for example, approximately 2 inches to 24 inches, more preferably 7 inches to 16 inches, and most preferably 8 inches. When two or more panels 60 are used on a wall the first sheet 62 of one panel 60 may align directly with the second sheet 64 of a second panel 60 covering the entire space between two studs. Alternatively, when two or more panels 60 are used on a wall the first sheet 62 of one panel 60 may overlap with the second sheet 64 of a second panel 60 to cover the entire space between two studs. The first sheet 62 of one panel 60 may overlap by as little as a half inch to as much as the entire distance between the two studs, for example, about 12 to 24 inches, and more preferably about 14 inches. In addition, when two or more panels 60 are used on consecutive studs, storage inserts, for example, shelves, containers, hooks, holders, and the like may be secured in the openings 24 on the studs. If only one panel 60 is used it is contemplated that hooks and holders may be secured to only one stud.

Figure 14:
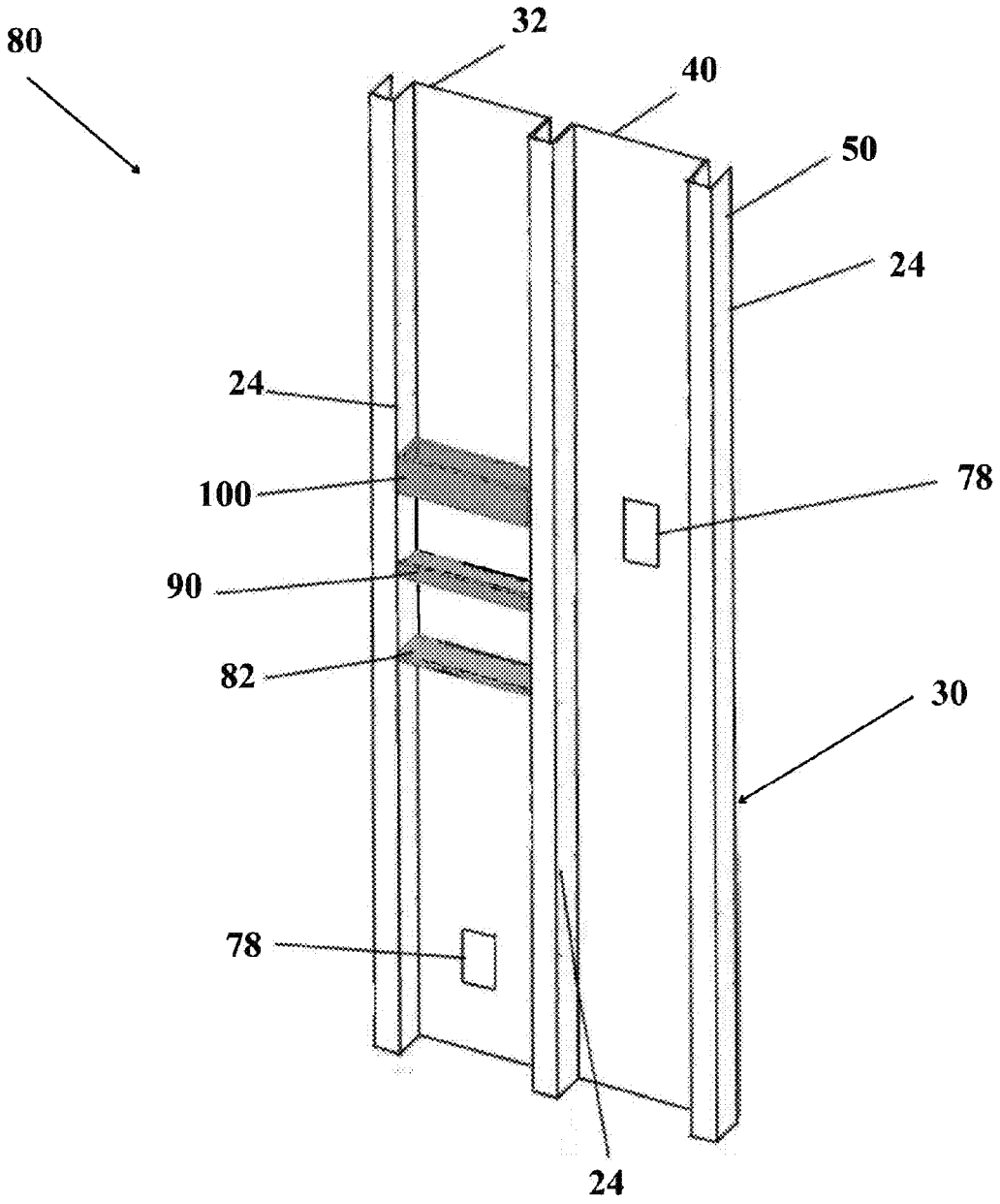
FIG. 14 is an isometric view of the wall panel of FIG. 5 including three storage inserts, in accordance with an aspect of the present invention.

Further, the panels 10, 32, 40, 50, and 60 may be used to cover unfinished, un-insulated walls with exposed studs, such as may be found in, for example, in garages, sheds, basements, attics, and any other structures or areas within a house or building with non-finished walls. The exposed studs may range from, for example, approximately 2 inches by 4 inches to approximately 2 inches by 6 inches, as well as any other dimension studs that are used for framing. The space between the studs on the wall to be covered by one or more panels 10, 32, 40, 50, and 60 may be from, for example, approximately 10 to 24 inches, more preferably between 14 and 18 inches, and most preferably 14 inches. As walls generally range from eight to twelve feet in height, the panels may come in, for example, lengths of approximately eight to twelve feet and more preferably the panels will come in a twelve foot length which can be cut down to a shorter length when desired. The panels 10, 32, 40, 50, and 60 may be prefabricated to selected sizes. The panels 10, 32, 40, 50, and 60 may be made of, for example, a plastic, vinyl, or poly-carbon type material. It is preferable that the panels 10, 32, 40, 50, and 60 be made of a durable and water resistant material although other materials are contemplated. The panels 10, 32, 40, 50, and 60 may also be made in any color that may be desirable to consumers. It is also preferable that the panels 10, 32, 40, 50, and 60 be made of a material that is paintable so users may change the color of the panels as desired. In addition, openings 78, as depicted in FIG. 14, may be cut into the panels 10, 32, 40, 50, and 60 so windows, outlets, and switches are not covered by the panels 10, 32, 40, 50, and 60.

Figure 15:
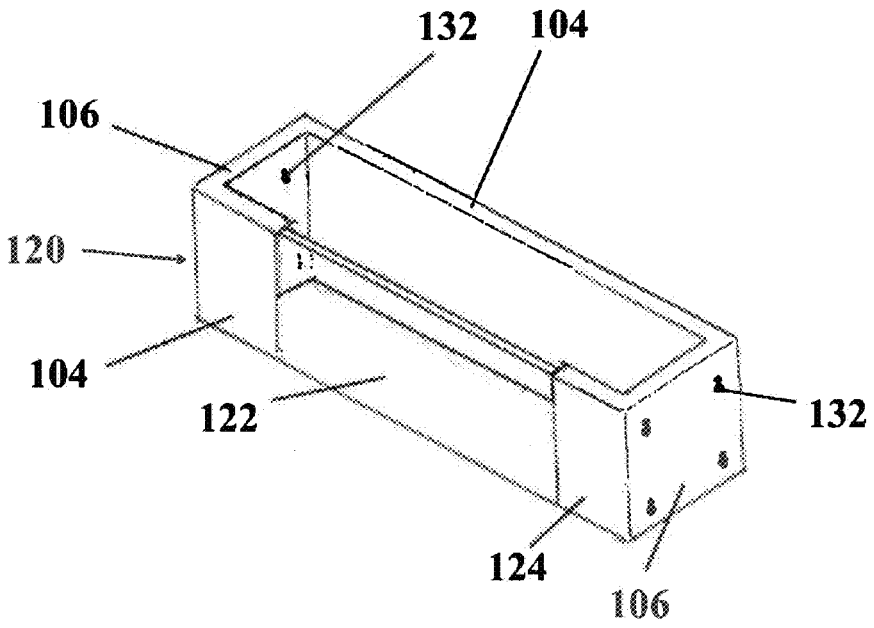
FIG. 15 is an isometric view of a storage insert, in accordance with an aspect of the present invention.
Figure 16:
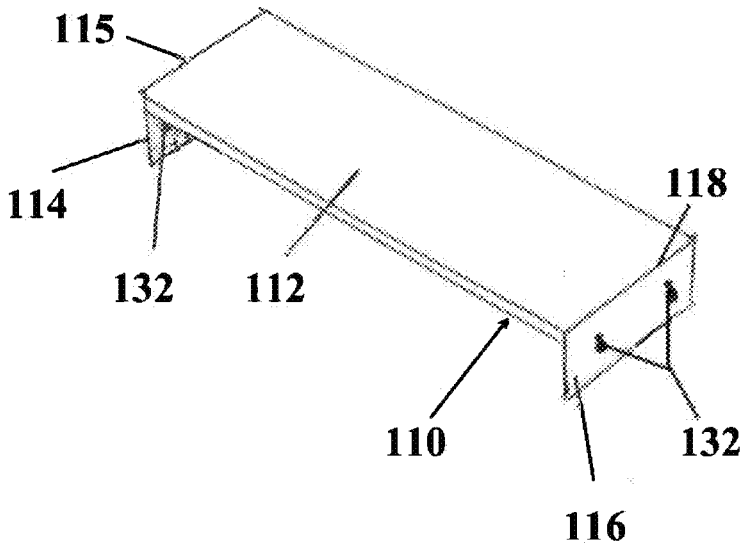
FIG. 16 is an isometric view of another storage insert, in accordance with an aspect of the present invention.
Figure 17:
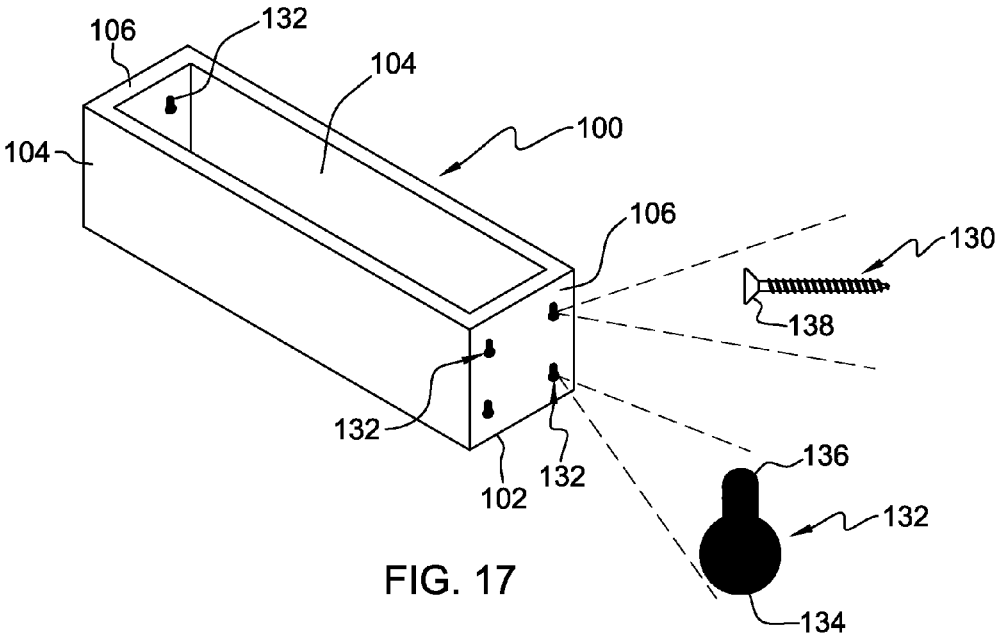
FIG. 17 is a partially exploded isometric view of yet another storage insert, in accordance with an aspect of the present invention.

Referring now to FIGS. 14-19, a wall panel system 80 is shown. The panel system 80 includes the wall panel system 30, as described above with reference to FIGS. 5-9, and three storage units or storage inserts, including a shelf 82, a lipped shelf 90, and a container 100. The plurality of openings 24 in the wall panel system 30 may be used to secure the wall panel system 30 to the studs and may also be used to secure the shelf 82, lipped shelf 90, and container 100 between two studs. Additional storage units, such as hooks, holders, and the like may be secured to only one stud. As best seen in FIG. 17, a fastener 130 may secure the container 100 or other storage unit to a stud by inserting the fastener 130 through the container 100 or other storage unit and into the stud. Alternatively, the container 100 or other storage unit may have a keyhole opening 132 enabling one or more fasteners 130 to be inserted into the stud and then the container 100 or other storage unit may be inserted and secured to the studs. The keyhole opening 132 having a first opening 134 for inserting the fastener 130 and a second opening 136 which is smaller than the first opening. A head 138 on the fastener 130 may be inserted into the first opening 134 and slid into the second opening 136 to secure the container 100 or other storage insert between the studs.

Figure 18:
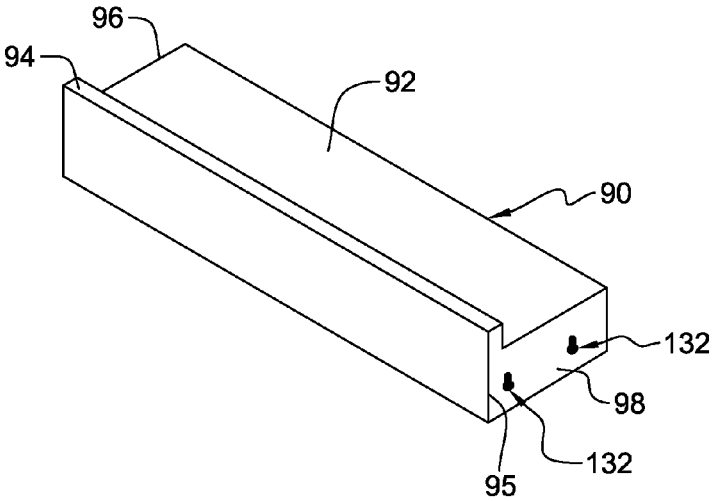
FIG. 18 is an isometric view of another storage insert, in accordance with an aspect of the present invention.
Figure 19:
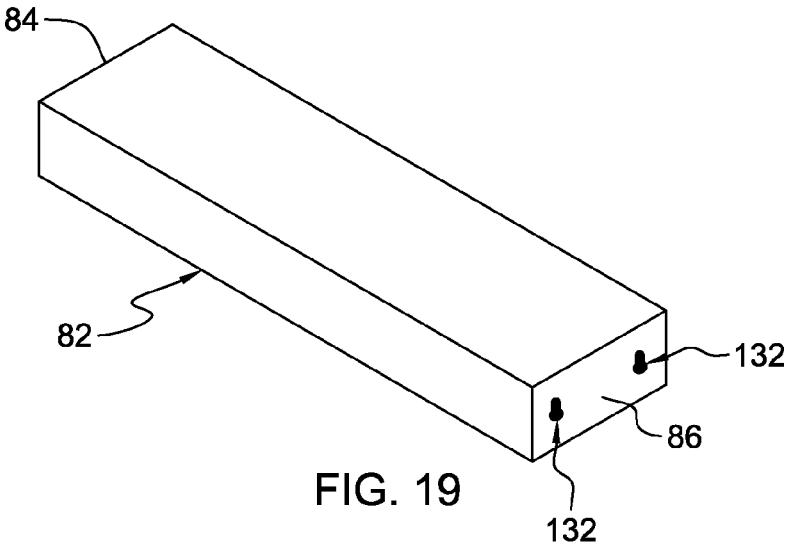
FIG. 19 is an isometric view of a further storage insert, in accordance with an aspect of the present invention.

As seen in FIG. 17 the container 100 includes a bottom 102, a pair of long sides 104, and a pair of short sides 106. The bottom 102 having a generally rectangular shape. The pair of long sides 104 attached perpendicular to the bottom 102 and on the long edges of the bottom. The pair of short sides 106 attached perpendicular to the bottom 102 and on the short edges of the bottom. Thus the bottom 102, pair of long sides 104, and the pair of short sides 106 create a container having a cavity for storing items with an open top. The pair of short sides 106 may include a fastener mechanism, such as, at least two keyhole openings 132, in the depicted embodiment there are four keyhole openings 132, for securing the container 100 between two adjacent studs. The lipped shelf 90 is depicted in FIG. 18 and includes a first horizontal member 92 and a lip 94 on a front side 95 of the first member 92. The first member 92 includes a first end 96 and a second end 98 wherein the first end 96 and second end 98 include two keyhole openings 132 for securing the lipped shelf 90 between two studs. Referring now to FIG. 19, the shelf 82 is a flat uniform thickness with a first end 84 and a second end 86. The first end 84 and the second end 86 including two keyhole openings 132 for securing the shelf 82 between two studs.

Additional storage containers are depicted in FIGS. 15 and 16. A container 120 including a see through window 122 is illustrated in FIG. 15. The container 120 is of the type described above with reference to FIG. 17 with a bottom 102, a pair of long sides 104, and a pair of short sides 106 and further includes a window 122 in the front side 124 of the container 120. The window 122 may cover the entire front side 124 of the container 120 or only a portion of the front side 124 of the container 120 to allow a user to view the contents of the container 120. The window 122 may be made of, for example, acrylic or a similar material that is not breakable and transparent or see through. The pair of short sides 106 may include at least two keyhole openings 132, there are four keyhole openings 132 in the depicted embodiment, for securing the container 120 between two studs. Depicted in FIG. 16 is a shelf 110 which includes a base 112, a first leg 114, and a second leg 116. The base 112 has a generally rectangular shape for fitting between two studs. The first leg 114 is attached at a first end 115 perpendicular to the base 112. The second leg 116 is attached at a second end 118 perpendicular to the base 112. In the depicted embodiment, the first leg 114 and the second leg 116 are below the base 112. However, it is also contemplated that the first leg 114 and the second leg 116 may be above the base 112 so the shelf is hanging from one or more fasteners 130. The first leg 114 and the second leg 116 include two keyhole openings 132 for securing the shelf 110 between two studs.

Figure 20:
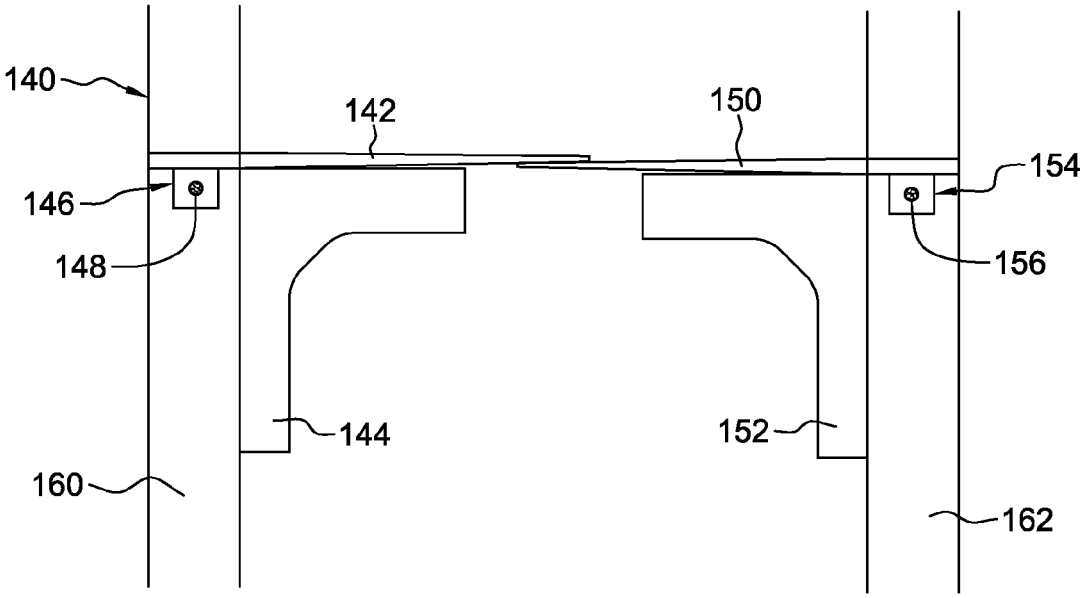
FIG. 20 is a front view of yet another storage insert, in accordance with an aspect of the present invention.
Figure 21:
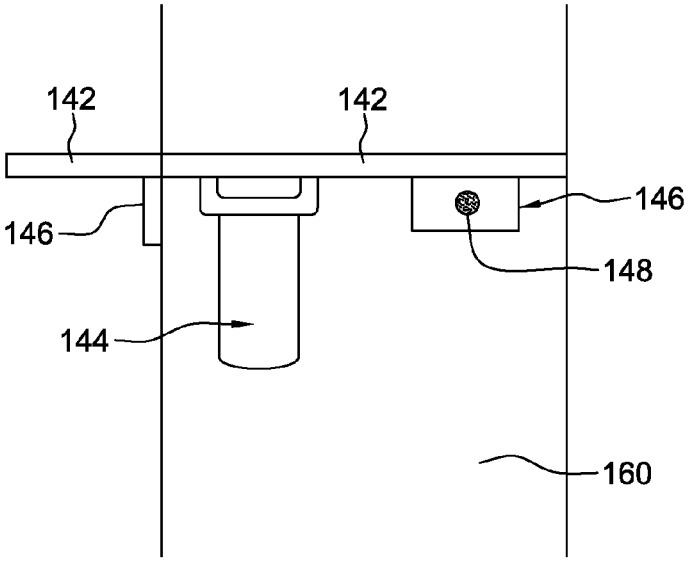
FIG. 21 is a side view of the storage insert of FIG. 20, in accordance with an aspect of the present invention.

Referring now to FIGS. 20-23, a shelf system 140 for attachment to at least two studs is shown. As seen in FIGS. 20 and 21, the shelf system 140 may include a first shelf portion 142, a first bracket 144, at least one first tab 146, a second shelf portion 150, a second bracket 152, and at least one second tab 154. The shelf system 140 may extend beyond the studs and be wide enough to hold larger items, for example, books, manuals, large cans of paint, or cans of varnish. For example, in one embodiment the first shelf portion 142 and second shelf portion 150 may extend approximately three inches in front of the studs, thus where a two by four inch stud is used the first and second shelf portions 142, 150 will be seven inches wide.

As shown in FIGS. 20 and 21, the first shelf portion 142 may be secured to the first bracket 144 and the first bracket 144 may be secured to a first panel 160 over a first stud with at least one fastener (not shown). At least one first tab 146 may extend perpendicularly from the first shelf portion 142. The at least one tab 146 may include at least one aperture 148 for inserting at least one fastener through the aperture 148 and into the first panel 160 and first stud. The second shelf portion 150 may be secured to the second bracket 152 and the second bracket 152 may be secured to a second panel 162 over a second stud with at least one fastener (not shown). At least one second tab 154 may extend perpendicularly from the second shelf portion 150. The at least one tab 154 may include at least one aperture 156 for inserting at least one fastener into the second panel 162 and the second stud.

Figure 22:
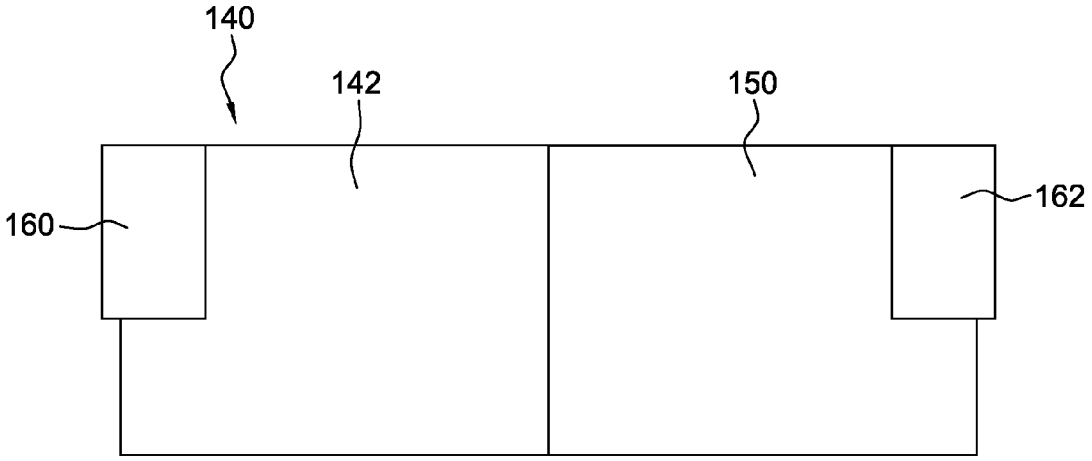
FIG. 22 is a top view of the storage insert of FIG. 20 in a first position, in accordance with an aspect of the present invention.
Figure 23:
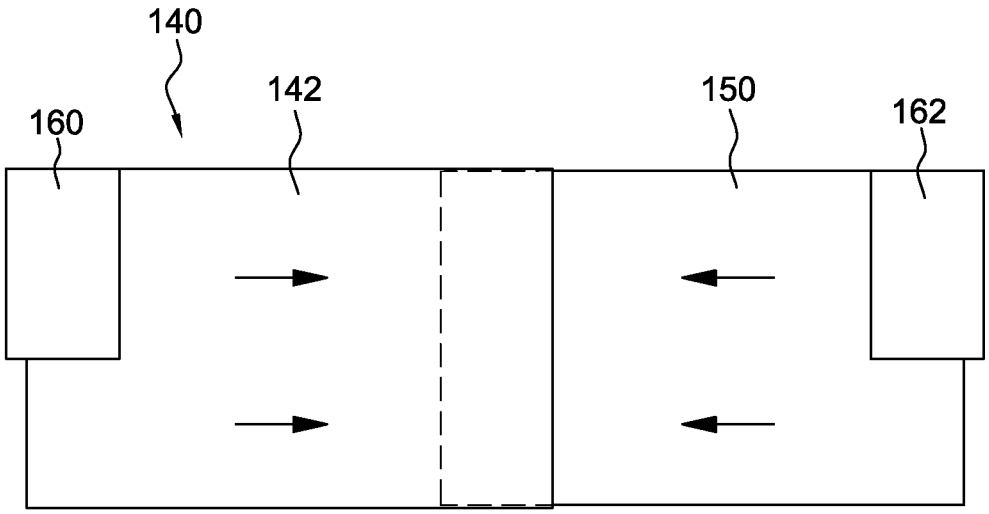
FIG. 23 is a top view of the storage insert of FIG. 20 in a second position in accordance with an aspect of the present invention.

As shown in FIG. 21, the first shelf portion 142 of the shelf system 140 may include two tabs 146, for example, the first tab 146 is aligned with the front of the panel 160 and a second tab 146 is aligned with the side of the panel 160. Similarly, the second shelf portion 150 may also include two tabs 154, a first tab 154 aligned with the front of the panel 162 and a second tab 154 aligned with the side of the panel 162. As seen in FIG. 22, the first shelf portion 142 may be adjacent to the second shelf portion 150 and the first shelf portion 142 may extend out in front of the panel 160 in front of the first stud and the second shelf portion 150 may extend out in front of the panel 162 in front of the second stud. As shown in FIG. 23, the first shelf portion 142 and the second shelf portion 150 may overlap in the center of the studs where the length of the first shelf portion 142 and second shelf portion 150 is greater than the length between the two studs. Additional fastening mechanisms may also be used to assist in attaching the shelf system 140 to the panels 160, 162 and the studs.

The storage units, for example, shelves, inserts, containers, hooks, holders, and the like may be secured between two studs to store various items. The placement and organization of the storage units may be completely customizable for the user using the plurality of openings 24. The storage units may be removable so the user can change the customization of the storage units. In addition the storage units 82, 90, 100, 110, 120, 140 may be made of, for example, a plastic or metal materials. The shelves and containers 82, 90, 100, 110, 120, 140 are sized to fit the space between the framing studs on the wall and may be from, for example, about 10 to 24 inches, more preferably between about 14 and 18 inches, and most preferably about 14 inches. The storage units 82, 90, 100, 110, and 120 may be comprised of a first portion and a second portion. The first portion and second portion of the storage units 82, 90, 100, 110, and 120 may overlap as described above with reference to the shelf system 140 to enable the storage units to be adjusted to fit between studs separate by various widths.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprise" (and any form of comprise, such as "comprises" and "comprising"), "have" (and any form of have, such as "has", and "having"), "include" (and any form of include, such as "includes" and "including"), and "contain" (and any form of contain, such as "contains" and "containing") are open-ended linking verbs. As a result, a method or device that "comprises," "has," "includes," or "contains" one or more steps or elements possesses those one or more steps or elements, but is not limited to possessing only those one or more steps or elements. Likewise, a step of a method or an element of a device that "comprises," "has," "includes," or "contains" one or more features possesses those one or more features, but is not limited to possessing only those one or more features. Furthermore, a device or structure that is configured in a certain way is configured in at least that way, but may also be configured in ways that are not listed.

The invention has been described with reference to the preferred embodiments. It will be understood that the architectural and operational embodiments described herein are a plurality of possible arrangements to provide the same general features, characteristics, and general system operation. Modifications and alterations will occur to those skilled in the relevant art that various modifications, additions and substitutions can be made without departing from its essence and therefore these are to be considered to be within the scope of the following claims.

Having thus described the preferred embodiments, the invention is now claimed to be:

1. A wall panel for covering an unfinished wall including one or more studs, comprising:

a first wall panel comprising:

a first sheet with a length, a width, a first edge, and a second edge;

a second sheet with a length, a width, a first edge, and a second edge;

a first stud cover attached perpendicular to the first sheet at the first edge and attached perpendicular to the second sheet at the second edge;

wherein the first stud cover includes a base with a first side and a second side, a first leg attached perpendicular to the base at the first side, and a second leg attached perpendicular to the base at the second side and wherein the first leg and second leg are parallel and the second side of the first stud cover includes a plurality of openings;

wherein the first sheet and the second sheet are planar from the first edges to the second edges as the first sheet and the second sheet extend away from the first stud cover; and wherein the second sheet is aligned with the first sheet;

a second wall panel comprising:

a second stud cover including a base with a first side and a second side, a first leg attached perpendicular to the base at the first side, and a second leg attached perpendicular to the base at the second side and wherein the first leg and second leg are parallel;

a first sheet with a first edge and a second edge, wherein the first sheet is attached perpendicular to the first side of the second stud cover at the first edge;

a second sheet with a first edge and a second edge, wherein the second sheet is attached perpendicular to the second side of the second stud cover at the second edge;

wherein the first sheet of the second wall panel at least partially overlaps the second sheet of the wall panel; and at least one storage unit mounted to the first stud cover at a first end and the second stud cover at a second end.

2. The wall panel of claim 1, wherein the first stud cover is mounted to a first stud.

3. The wall panel of claim 2, wherein the second stud cover is mounted to a second stud and the first stud is adjacent to the second stud and further comprising:

a third stud cover, wherein the third stud cover includes a base with a first side and a second side, a first leg attached perpendicular to the base at the first side, and a second leg attached perpendicular to the base at the second side and wherein the first leg and second leg are parallel; and wherein the third stud cover is mounted to a third stud and the third stud is adjacent to the second stud.

4. The wall panel of claim 1, wherein the at least one storage unit is selected from the group consisting of a shelf, a container, a hook, a holder, and an insert.

5. The wall panel of claim 1, wherein the at least one storage unit is a shelf system, the shelf system comprising:

a first shelf portion including a first end, a second end, a top surface, and a bottom surface;

a first bracket including a first portion and a second portion, the first portion being positioned generally perpendicular to the second portion, and wherein the first portion is secured to the first stud cover and the second portion engages the bottom surface of the first shelf portion;

a second shelf portion including a first end, a second end, a top surface, and a bottom surface;

a second bracket including a first portion and a second portion, the first portion being positioned generally perpendicular to the second portion, and wherein the first portion is secured to the second stud cover and the second portion engages the bottom surface of the second shelf portion; and wherein the second end of the first shelf portion at least partially overlaps the first end of the second shelf portion.

6. The wall panel of claim 5, wherein the shelf system, further comprises:

at least one first tab extending away from the bottom surface of the first shelf portion and including at least one aperture for attaching the first shelf portion to the first stud cover; and at least one second tab extending away from the bottom surface of the second shelf portion and including at least one aperture for attaching the second shelf portion to the second stud cover.

7. The wall panel of claim 6, wherein the first shelf portion extends from the second sheet of the wall panel out past the base of the first stud cover and the second shelf portion extends from the first sheet of the second wall panel out past the base of the second stud cover.

8. The wall panel of claim 7, wherein the first shelf portion extends in front of the base portion of the first stud cover and the second shelf portion extends in front of the base portion of the second stud cover.

9. The wall panel of claim 8, wherein the at least one first tab includes two tabs, one tab extends down from the bottom surface at the first end of the first shelf portion and is secured to the second leg of the wall panel and the second tab extends down from the bottom surface of the first shelf portion extending in front of the base portion of the first stud cover and is secured to the base portion of the first stud cover; and wherein the at least one second tab includes two tabs, one tab extends down from the bottom surface at the second end of the second shelf portion and is secured to the first leg of the second wall panel and the second tab extends down from the bottom surface of the second shelf portion extending in front of the base portion of the second stud cover and is secured to the base portion of the second stud cover.

10. A wall panel system for covering an unfinished wall including one or more studs, comprising:

a first stud cover including a base with a first side and a second side, a first leg with a front edge and a back edge is attached perpendicular to the base at the first side, and a second leg with a front edge and a back edge is attached perpendicular to the base at the second side, wherein the first leg and second leg are parallel and wherein the first leg includes a plurality of apertures and the second leg includes a plurality of apertures;

a first sheet attached perpendicular to the first leg on the back edge of the first leg, wherein the first sheet and base are parallel;

a second sheet attached perpendicular to the second leg on the back edge of the second leg, wherein the second sheet and base are parallel;

a second stud cover including a base with a first side and a second side, a first leg attached perpendicular to the base at the first side, and a second leg attached perpendicular to the base at the second side and wherein the first leg and second leg are parallel;

a first sheet attached perpendicular to the first leg on a back edge, wherein the first sheet and base are parallel;

a second sheet attached perpendicular to the second leg on a back edge, wherein the second sheet and base are parallel; and at least one first storage unit is removably coupled to the first stud cover, wherein the at least one first storage unit comprises:

a first shelf portion including a first end, a second end, a top surface, and a bottom surface;

a first bracket including a first portion and a second portion, the first portion being positioned generally perpendicular to the second portion, and wherein the first portion is secured to the first stud cover and the second portion engages the bottom surface of the first shelf portion;

a second shelf portion including a first end, a second end, a top surface, and a bottom surface;

a second bracket including a first portion and a second portion, the first portion being positioned generally perpendicular to the second portion, and wherein the first portion is secured to the second stud cover and the second portion engages the bottom surface of the second shelf portion; and wherein at least a portion of the first shelf portion and at least a portion of the second shelf portion overlap when the first stud cover is positioned adjacent to the second stud cover and the first shelf portion extends out from the second leg of the first stud cover and the second shelf portion extends out from the first leg of the second stud cover.

11. The wall panel system of claim 10, further comprising:

at least one storage unit removably coupled to at least one stud cover.

12. The wall panel system of claim 11, wherein the at least one second storage unit is a hook.

13. A method of mounting a wall panel to an unfinished wall including one or more studs, comprising:

obtaining a wall panel, comprising:

a first stud cover, the first stud cover comprising a base with a first side and a second side, a first leg with a front edge and a back edge is attached perpendicular to the base at the first side, and a second leg with a front edge and a back edge is attached perpendicular to the base at the second side, wherein the first leg and second leg are parallel and wherein the first leg includes a plurality of apertures and the second leg includes a plurality of apertures;

a first sheet attached perpendicular to the second leg on a back edge of the second leg of the first stud cover, wherein the first sheet and base are parallel;

a second sheet attached perpendicular to the first leg on a back edge of the first leg of the first stud cover, wherein the second sheet and base are parallel and the first sheet and second sheet are planar;

a second stud cover including a base with a first side and a second side, a first leg attached perpendicular to the base at the first side, and a second leg attached perpendicular to the base at the second side and wherein the first leg and second leg are parallel;

a first sheet attached perpendicular to the first leg on a back edge of the second stud cover, wherein the first sheet and base are parallel; and a second sheet attached perpendicular to the second leg on a back edge of the second stud cover, wherein the second sheet and base are parallel;

aligning the first stud cover over a first stud;

sliding the first stud cover over the first stud;

inserting at least one fastener through the first stud cover and into the first stud and aligning the second stud cover over a second stud;

sliding the second stud cover over the second stud, wherein the first sheet attached to the second stud cover at least partially overlaps the second sheet attached to the first stud cover;

inserting at least one fastener through the second stud cover and into the second stud;

aligning at least one first storage unit at a first end to the first stud and at a second end to the second stud; and inserting at least two fasteners to mount the at least one storage unit between the first stud cover and the second stud cover.

14. The method of claim 13, wherein the first stud is adjacent the second stud and wherein at least one storage unit comprises:

a first shelf portion including a first end, a second end, a top surface, and a bottom surface;

a first bracket including a first portion and a second portion, the first portion being positioned generally perpendicular to the second portion, and wherein the first portion is secured to the first stud cover and the second portion engages the bottom surface of the first shelf portion;

a second shelf portion including a first end, a second end, a top surface, and a bottom surface;

a second bracket including a first portion and a second portion, the first portion being positioned generally perpendicular to the second portion, and wherein the first portion is secured to the second stud cover and the second portion engages the bottom surface of the second shelf portion; and wherein at least a portion of the first shelf portion and at least a portion of the second shelf portion overlap when the first stud cover is positioned adjacent to the second stud cover and the first shelf portion extends out from the second leg of the first stud cover and the second shelf portion extends out from the first leg of the second stud cover.

* * * * *